US005205676A

United States Patent [19]

Heiliger

[11] Patent Number: 5,205,676

[45] Date of Patent: Apr. 27, 1993

[54] HYDRAULIC STEEL MINE PROP

[76] Inventor: Robert W. Heiliger, Hochkoppel 11, D 5166 Kreuzau-Untermaubach, Fed. Rep. of Germany

[21] Appl. No.: 781,223

[22] PCT Filed: Apr. 13, 1991

[86] PCT No.: PCT/EP91/00706

§ 371 Date: Jan. 6, 1992

§ 102(e) Date: Jan. 6, 1992

[87] PCT Pub. No.: WO91/18186

PCT Pub. Date: Nov. 28, 1991

[30] Foreign Application Priority Data

May 11, 1990 [DE] Fed. Rep. of Germany ... 9005343[U]

[51] Int. Cl.[5] ..... E21D 15/44

[52] U.S. Cl. ..... 405/290; 248/354.1; 405/288

[58] Field of Search ..... 405/290, 288, 303, 291-296; 91/170 MP; 248/351, 354.1

[56] References Cited

U.S. PATENT DOCUMENTS

| | | | |
|---|---|---|---|
| 1,579,913 | 4/1926 | Bronson | 405/290 X |
| 2,621,631 | 12/1952 | Dowty | 405/290 X |
| 4,255,071 | 3/1981 | Koppers et al. | 405/290 |
| 5,026,218 | 6/1991 | Zimmerman | 405/290 |
| 5,051,039 | 9/1991 | Heiliger . | |

FOREIGN PATENT DOCUMENTS 0349942 1/1990 European Pat. Off. .

*Primary Examiner*—Dennis L. Taylor
*Attorney, Agent, or Firm*—W. G. Fasse

[57] ABSTRACT

A hydraulic steel mine prop having a bottom ram including an outer cylindrical tube with a cylinder foot at one end and a collar ring at the other end, and with a top ram coaxially guided in the bottom ram. The top ram is substantially a cylindrical tube with a piston at its one end, whereby the piston is guided in and sealed relative to the inner wall of the outer cylindrical tube, and with a prop head at its other end. The top ram includes an inner prop extension stop and a return spring formed as a screw spring which is secured with one end to the prop head and with the other end to the cylinder foot. The return spring passes through a bore in the piston, whereby a further tube which encloses the spring, is arranged coaxially between the prop head and the piston. The piston includes a safety valve which relieves the pressure from a compression chamber when the piston assumes a predetermined end position. To simplify operating the safety valve in a positive manner the screw spring is divided into two separate spring members.

4 Claims, 1 Drawing Sheet

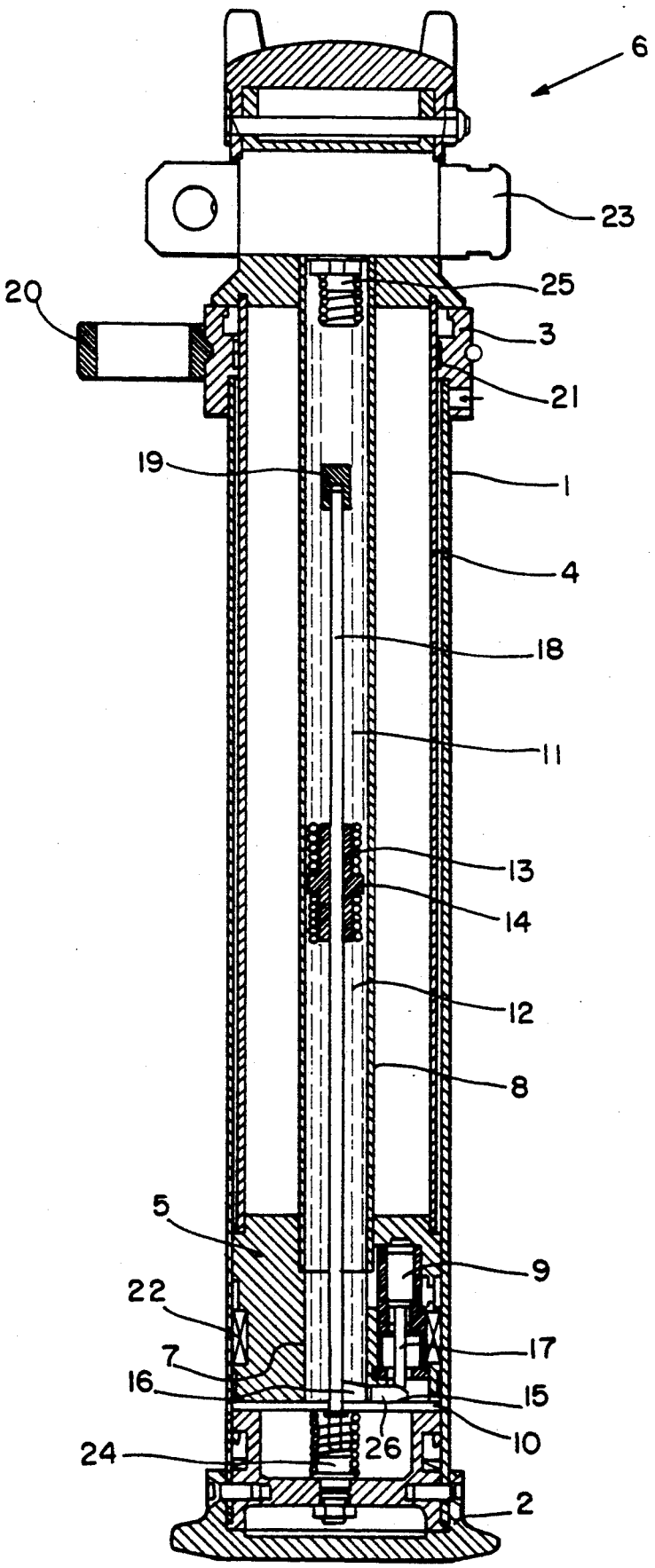
6
23
25
20
3
21
19
1
4
18
11
13
14
12
8
5
9
22
17
7
16
15
10
24
26
2

HYDRAULIC STEEL MINE PROP

FIELD OF THE INVENTION

The invention relates to a hydraulic steel mine prop having a bottom ram substantially including an outer cylindrical tube with a cylinder foot at one end and a collar ring at the other end, and further including a top ram coaxially guided in the bottom ram.

BACKGROUND INFORMATION

In mine props of this type the top ram comprises substantially a cylindrical sealed relative to the inner wall of the outer cylindrical tube and which has a prop head at its other end. The top ram further includes an inner prop extension stop and a return spring formed as a screw spring which is secured with one end to the prop head and with the other end to the cylinder foot. The return spring passes through a bore in the piston, whereby a further tube which encloses the spring is arranged coaxially between the prop head and the piston. The piston includes a safety valve which relieves the pressure from the compression chamber when the piston assumes a predetermined end position.

A hydraulic steel mine prop as just described is known from German Utility Model Publication (DE-G) 8,808,519 corresponding to 5,051,039 (Heiliger). Props of this construction do not have an inner mechanical stop which limits the prop extension and takes up the prop extension force. Thus, one version of such props comprise a safety valve in the piston, which valve is operated by mechanical means in the desired end position for releasing the pressure from the compression chamber so that a further prop extension becomes impossible. The mechanical structure conventionally used for this purpose is, on the one hand relatively expensive, and on the other hand, the known structure permits only a passive switching of the safety valve. This means that the safety valve, due to its internal mechanical features, is operated at a switching point and not at all from the outside in a positive manner.

OBJECT OF THE INVENTION

It is the purpose of the invention to solve the problem of simplifying the operating mechanism for the safety valve and to construct this mechanism so that a positive operation of the safety valve is achieved.

SUMMARY OF THE INVENTION

Starting with a hydraulic steel mine prop of the type described above, the above problem has been solved according to the invention in that the spring is divided into two separate spring members which are interconnected by an intermediate member at the separation point, whereby the intermediate member comprises a flange extending outside of the outer spring diameter, said flange cooperating with an operating element guided at the piston in the desired end position of the piston for moving the operating element which in turn activates the safety valve.

Thus, rather very simple features are used, namely only the divided spring with the intermediate member. The spring functions simultaneously as a return spring and as a carrier for the intermediate member. The intermediate member itself moves slower than the piston due to its clamping in the spring when the prop is being extended so that the piston with the safety valve sometimes reaches the intermediate member. This position can be exactly predetermined by the arrangement of the intermediate member. When the intermediate member is reached, the operating element also reaches the intermediate member and is thus operated by the intermediate member due to the movement of the piston past the intermediate member. The intermediate member on its part operates now the safety valve in a positive manner. In this connection the operating element may quite easily be a crosswise extending slide member which engages the flange of the intermediate member while the piston passes the intermediate member, whereby the operating element is displaced crosswise and the crosswise displacement operates the safety valve. The intermediate member cannot escape radially even though it is mounted in the spring, because the intermediate member is guided in the tube that encloses the spring, whereby the intermediate member if it tries to radially yield, bears against the opposite wall area of the tube, whereby a further radial yielding movement becomes impossible.

According to a further embodiment of the invention, it is provided that a pull rod is arranged coaxially to the spring and secured to the cylinder foot to reach into the spring, said rod passing through the intermediate member and being equipped at its free end with a stop for the intermediate member. The location of the stop for the intermediate member now determines the switching point for the safety valve and thus for the prop extension stroke. During the prop extension movement the intermediate piece travels along the pull rod upwardly until it at last comes to bear against the stop which leads the respective stop force through the pull rod into the cylinder foot. Once the intermediate member has engaged the stop, it cannot travel any further so that the piston again passes the intermediate member with a respective extension length of the cylinder, whereby the safety valve in the piston is positively operated in the manner described above.

A further embodiment of the invention provides that the operating element is constructed as a two-armed lever which is tiltably secured to the piston so that one arm rests against a valve stem of the safety valve and so that the second arm can be brought into contact with the flange of the intermediate member. This is an especially simple form of a motion direction control, whereby this two-armed lever also makes possible a positive operation of the safety valve.

A further advantageous embodiment of the invention provides that the second arm is constructed as a two-pronged fork having curved prongs which reach approximately halfway around the spring with a small spacing. Hereby, the dimensions are such that the flange of the intermediate member does not fit through between the prongs of the fork, but rather stops the same so that in any event, a reliable positive switching takes place without the possibility that small wear and tear of the flange or of the operating element result in a faulty function.

BRIEF DESCRIPTION OF THE DRAWING

The invention will now be described in more detail with reference to the example embodiment shown in the single FIGURE of the accompanying drawing.

The FIGURE shows a longitudinal section through a hydraulic steel mine prop which corresponds in its construction substantially to the prior art described above. An outer cylindrical tube 1 forming part of the bottom ram is closed at its lower end in a sealed manner by the cylinder foot 2. The cylinder foot 2 may comprise several individual components which are not described in more detail since they are known. The other end of the outer cylindrical tube 1 is closed by a collar ring 3 which normally is equipped with a handle 20. On its inwardly facing area, the collar ring 3 comprises a seal 21 which rests against the outer surface of an inner cylindrical tube 4. The inner cylindrical tube 4 is closed at its upper end by a prop head 6 and at its lower end by a piston 5. The piston 5 rests with a seal 22 in a sealed manner against the inner surface of the outer cylindrical tube 1. The piston comprises additionally an eccentrically arranged safety valve 9 and a coaxially extending through bore 7. A pipe 8 is arranged coaxially to this through bore 7 and coaxially to a respective socket, not referred to in detail, in the prop head. Said pipe extending between the prop head 6 and the piston 5, thereby interconnecting the prop head 6 and the piston 5. A medium under pressure can flow through this pipe and through the bore 7 of the piston 5 controlled by a setting and removal valve 23 arranged in the prop head 6.

A screw tension spring which is divided into two individual spring sections 11 and 12 passes through the pipe 8 and is secured to the prop head 6. An intermediate member 13 is provided at the separation point, the position of which can be selected as desired relative to the intended switching point. The intermediate member 13 comprises a flange 14 between the ends of the two spring sections. The flange 14 has a diameter larger than the outer diameter of the spring sections. Hereby, the flange 14 of the intermediate member 13 is freely movable within the pipe 8 and comprises relative to the inner wall of the pipe 8 a gap of sufficient size for the necessary passage of the liquid under pressure. The second end of the individual spring section 12 passes hereby through the bore of the piston 5 and is secured to the cylinder foot 2. Screw balls are used for securing the two outer ends of the individual spring sections 11 and 12. These screw balls have a threading which in its curvature and in its pitch is adapted to the respective spring dimensions. Thus, it is possible when the spring is relaxed, to screw the respective screw bolt 24 or 24 into the end of the spring. If the spring is now exposed to a tension force, the spring diameter will become smaller so that the spring is rigidly held at the respective screw bolt 24 or 25. In the same manner the intermediate member 13 may comprise respective threadings adapted to the spring dimensions for the securing of the spring ends. The screw bolts 24 or 25 are in turn secured to the cylinder foot 2 or to the ram head 6.

A pull rod 18 is arranged coaxially to the springs 11 and 12 and passes through a longitudinal bore not designed in detail, through the intermediate member 13. The pull rod 18 is secured with its one end to the cylinder foot 2 by a respective securing device in the screw bolt 24. The pull rod 18 carries at its free end a stop 19. The stop 19 may, for example, be screwed to the rod 18. During the extension movement of the prop, the stop 19 serves for the purpose to hinder a further upward movement of the upwardly moving intermediate member 13. Thus, the intermediate member 13 comes to bear against the stop 19 and thus cannot further move even if the cylinder continues to move outwardly. Accordingly, the position of the stop 19 determines the end position of the intermediate member 13 and thus the switching point for the safety valve 9.

The safety valve 9 is operated by a vertically extending valve stem 17 which bears against an arm 15 of a two-armed lever, the second arm 16 of which is constructed as a fork with two curved prongs. The two curved prongs encircle approximately one half of the outer circumference of the spring section 12 with a small play. The two individual lever arms 15 and 16 together form a two-armed lever which is journalled in the piston 5 on a shaft 26 so that a tilting motion of this two-armed lever can operate the valve stem 17.

If the compression space 10 is charged with, for example, water under pressure, the piston 5 travels upwardly, whereby the individual spring sections 11 and 12 are lengthened. As a result, the intermediate member 13 travels simultaneously upwardly, however, with a slower speed than that of the piston 5. The intermediate member 13 travels upwardly until it engages the stop 19. The starting position of the intermediate piece 13 and the position of the stop 19 should be so selected that at the time when the intermediate member 13 comes to bear against the stop 19, the piston 5 should simultaneously bear against the intermediate member 13 with the second arm 16 at the flange 14 of the intermediate member 13. During a further upward movement of the piston 5, the two-armed lever is tilted about the shaft 26 because the second arm 16 rests against the flange 14 of the intermediate member 13, so that the first arm 15 operates the valve stem 17, and thus opens the safety valve 9. By the opening of the safety valve 9, the pressure in the compression chamber 10 is immediately released in a known manner and a further upward movement of the piston 5 is thus no longer possible. Since the safety valve 9 is positively activated and thus operated, the basically present uncertainty of a passive activation has been removed.

Although the invention has been described with reference to specific example embodiments, it will be appreciated to cover all modifications and equivalents within the scope of the appended claims.

I claim:

1. A hydraulic steel mine prop, comprising a bottom ram including an outer cylindrical tube with a cylinder foot at one end and a collar ring at the other end, and further including a top ram coaxially guided in said bottom ram, said top ram comprising a cylindrical tube having at its one end a piston that is guided in and sealed relative to the inner wall of the outer cylindrical tube and which has a prop head at its other end, said top ram further including an inner prop extension stop and a return spring formed as a screw spring which is secured with one end to said prop head and with its other end to said cylinder foot, said return spring passing through a bore in said piston, whereby a further tube which encloses said screw spring, is arranged coaxially between said prop head and said piston, said piston including a safety valve which relieves pressure from a compression chamber when said piston assumes a predetermined end position, wherein said screw spring is divided into two separate spring members (11, 12) which are interconnected by an intermediate member (13) at a separation location, said intermediate member (13) comprising a flange extending outside of an outer spring diameter, an operating element, said flange cooperating with said operating element guided by said piston (5) in a desired end position of said piston for moving said operating element which in turn activates said safety valve (9).

2. The steel mine prop of claim 1, further comprising a pull rod arranged coaxially to said spring (11, 12) and secured to said cylinder foot (2), said pull rod extending into said spring (11, 12) and through said intermediate member (13), said pull rod comprising at its free end a stop (19) for said intermediate member.

3. The steel mine prop of claim 1, wherein said operating element is constructed as a two-armed lever which is journalled to the piston (5) and which bears with one arm against a valve stem (17) of said safety valve (9) and which can be brought into contact with its second arm (16) with said flange (14) of said intermediate member (13).

4. The steel mine prop of claim 3, wherein said second arm (16) is constructed as a two-pronged fork, the curved prongs of which extend approximately halfway around the outer circumference of said spring (12) with a small spacing between said spring and said prongs.

* * * * *